United States Patent [19]

Oya et al.

[11] 4,432,265

[45] Feb. 21, 1984

[54] ELECTRONIC MUSICAL INSTRUMENT CONTROLLING TONE PROPERTIES BY CONTROL DATA SIGNALS

[75] Inventors: Akiyoshi Oya; Tomoaki Sekiguchi, both of Hamamatsu, Japan

[73] Assignee: Nippon Gakki Seizo Kabushiki Kaisha, Hamamatsu, Japan

[21] Appl. No.: 393,751

[22] Filed: Jun. 30, 1982

[30] Foreign Application Priority Data

Jul. 9, 1981 [JP] Japan ..... 56-101166[U]

[51] Int. Cl.[3] ..... G10H 1/053; G10H 1/18

[52] U.S. Cl. ..... 84/1.01; 84/1.19; 84/1.24

[58] Field of Search ..... 84/1.01, 1.19–1.27

[56] References Cited

U.S. PATENT DOCUMENTS 4,184,403 1/1980 Whitefield ..... 84/1.19 X 4,240,318 12/1980 Gross ..... 84/1.01

4,348,929 9/1982 Gallitzendörfer ..... 84/1.01

*Primary Examiner*—S. J. Witkowski

*Attorney, Agent, or Firm*—Spensley, Horn, Jubas & Lubitz

[57] ABSTRACT

An electronic musical instrument comprises a tone generator which generates tone signals having tone pitches as designated by playing keys and tone properties as determined by control data signals applied thereto. A set of control data signals are provided in a digital format and delivered timewisely in serial form to manual setting units. The serial signals are converted into parallel signals and applied to the respective setting units for desired adjustment. The adjusted or non-adjusted parallel signals are converted back into serial signals and applied to the tone generator. Interpolator circuits are provided between the setting units and the tone generator to apply the latter control data signals whose values vary gradually even when the values of the signals from the setting units exhibit abrupt large changes from certain values to another.

11 Claims, 15 Drawing Figures

ELECTRONIC MUSICAL INSTRUMENT CONTROLLING TONE PROPERTIES BY CONTROL DATA SIGNALS

BACKGROUND OF THE INVENTION

This invention relates to an electronic musical instrument capable of controlling various tone properties of a musical tone such as the tone color, tone level, tone pitch and tonal effect by control data signals.

In an electronic musical instrument, manual operators are provided for individually setting control data signals representing tone properties such as the tone color, tone level, tone pitch, footage and various tonal effects, and the control data signals are generated in accordance with set states of the respective manual operators. The respective tone properties of the tone signals to be generated by a tone generator are controlled by these control data signals. There has also been known in the art a preset device in which signal states of a set of control data signals corresponding to various tone properties are preset and the preset control data signals are read out collectively by switch means to be utilized for controlling the tone properties. Such preset device is advantageous in that desired signal states of a set of control data signals can be provided collectively so that setting of the respective tone properties can be facilitated. The prior art preset device is not so convenient, however, in a case where it is desired to change only a part of the control data, particularly to change it temporarily. Since the prior art preset device is so constructed that a set of the tone properties are collectively selected from among one or more sets of the tone properties, a partial change in the tone properties can be realized only by preparing newly a set of control data signals representing the respective tone properties including the tone properties in which the desired change has been made. The new preparation of a set of control data signals requires replacement of a read-only memory (ROM) if the read-only memory is employed as a memory device in the preset device whereas it requires rewriting of a random-access memory (RAM) if the random-access memory is employed as the memory device. In any case, such replacement or rewriting is troublesome. On the other hand, in a case where the control data signals are provided in a digital format, there arises a problem that wiring must be saved in sending and receiving these signals.

It is, therefore, an object of the invention to facilitate both setting and modification of the tone properties and realize it with a saved number of wiring. More specifically, it is an object of the invention to facilitate the setting of the tone properties by preparing one or more sets of control data signals representing the respective tone properties and, when a set of control data signals are used in the tone generator, to enable preset signal states of the set of control data signals to be held without being cancelled while enabling only a portion of the control data signals used in the tone generator to be selectively modified or adjusted. It is also a specific object of the invention to realize the delivery of the set of control data signals by a relatively small number of wiring.

The manual operators generally include those for setting the tone level with respect to each tone color, and a tone signal composed of tone colors for the respective manual operators which are mixed together at desired levels is produced by controlling a tone generator in accordance with the set states of the manual operators. The prior art electronic musical instrument has the problem that change in the set level of the manual operator by a relatively large amount causes an abrupt change in the tone signal resulting in occurrence of unpleasant noises such as clicking. Further, in a case where the respective tone properties are controlled by a set of preset control data signals, a relatively large change in the set level occurs when the control data signals are changed to another set of control data signals during performance, resulting in similar occurrence of the noises.

It is, therefore, another object of the present invention to mitigate such abrupt change in the tone properties by gradually and smoothly changing the set value of tone control data for controlling the tone properties such as the tone color, tone level, tone pitch, time and tonal effects when such set value has been changed.

SUMMARY OF THE INVENTION

The above described objects of the invention are achieved by an electronic musical instrument comprising control data providing means for providing at least a set of tone property control data signals in a digital format representing respective tone properties of tone signals to be generated by a tone generator, and outputting said set of control data signals timewisely in serial form, and control data setting means connected to the control data providing means and the tone generator. The control data setting means include serial to parallel conversion circuits receiving serial control data signals outputted by the control data providing means and converting the serial control data signals into parallel, a plurality of manual operator units connected to said serial to parallel conversion circuits and capable of setting by selectively either modifying or not modifying the parallel control data signals, and parallel to serial conversion circuits connected to said manual operator units and converting the parallel control data signals into serial ones. The serial control data signals outputted by the parallel to serial conversion circuits are applied to the tone generator. The tone generator generates tone signals of notes as respectively designated by depressed keys imparted with tone properties as determined by the control data signals applied thereto.

According to the invention, the control data signals provided from the control data providing means to the control data setting means and the control data signals supplied from the control data setting means to the tone generator are respectively in a serial format and, consequently, simplification in the wiring is realized. A set of control data signals provided from the control data providing means are not directly applied to the tone generator but applied thereto through the control data setting means. The control data signals can be modified by the manual operators included in the control data setting means. Accordingly, when the tone properties of the tone to be generated are determined according to the set of control data signals, an individual manual setting operation with respect to each tone property by means of each of the manual operator units can be reflected to the determination of the tone properties. As a result, setting of a set of tone properties can be facilitated and besides modification of a part of the tone properties, particularly a temporary modification thereof while maintaining original properties can be readily realized.

According to a preferred embodiment of the invention, the control data providing means includes a memory device storing plural sets of control data signals in a digital format and read-out means for selectively reading a set of control data signals out of the memory device and functions as preset means. Each of the manual operator units in the control data setting means includes storing means storing the control data signals provided by the serial to parallel conversion circuits to output the stored signal in parallel, manual switch means for modifying the values of the data signals stored in the storing means by operation of switches and display means for visually displaying the values of the data signals stored in the storing means.

For achieving one of the above-described objects of the invention, there are further provided interpolation circuits connected to the control data setting means for receiving at least one of the control data signals outputted therefrom and providing, when the value of the received signal varies from a first value to a second value, an interpolating value which varies gradually from said first value to said second value, and said interpolated signal and other control data signals which are not subjected to interpolation are both applied to the tone generator.

The interpolation circuit should preferably effect interpolation with respect to specific kind or kinds of data for which an abrupt change in the set value is undesirable among tone control data for a plurality of factors constituting a tone. The specific kinds of data to be controlled by the interpolation circuit must be one whose value can be selectigely set to any one of plural values, e.g., tone level setting data for each tone color, tone level setting data for each footage, data for setting the tone balance between respective keyboards, total tone level setting data, tone level setting data for each tonal effect and data for setting control factors such as time and pitch for each tonal effect. The interpolation circuit according to this invention can also be provided in an electronic musical instrument of a type where the tone level, tone color and tonal effects can be set by a selective operation between two states of ON and OFF and, in this case also, an abrupt change in the tone level, tone color and tonal effects can be prevented.

In one embodiment, the interpolation circuit includes an output register or counter storing tone control data to be provided to the tone generator circuit and, if the value of the control data supplied from the control data setting means is different from the value held in this output register or counter, changes the value held in the output register or counter gradually in accordance with a predetermined interpolation function until the value held in the output register or counter coincides with the new tone control data. A desired function such as a logarithmic function (curve) or a linear function (curve) may be used for the interpolation function (curve).

BRIEF DESCRIPTION OF THE DRAWINGS

In the accompanying drawings.

DESCRIPTION OF PREFERRED EMBODIMENTS

Figure 1:
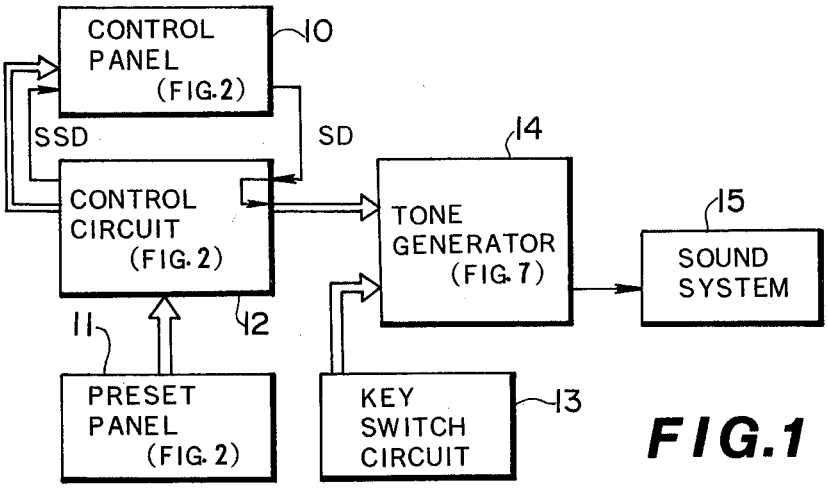
FIG. 1 is a block diagram showing an entire construction of an electronic musical instrument embodying the present invention.

Referring to FIG. 1, a preset panel 11 and a control circuit 12 constitute a control data providing section for applying a set of control data signals SSD timewisely in series to a control panel 10. The control panel 10 includes various manual operators for selecting or setting individually various tone properties such as a tone color, a tone level, a performance effect, etc., circuits for converting the serial control data signals SSD into parallel ones to apply the converted parallel signals to the manual operators, and circuits for converting back control data signals outputted by the manual operators into serial ones to output them as serial control data signals SD. The manual operators are capable of setting the control data signals SD by selectively either modifying or not modifying the respective control data signals SSD. The preset panel 11 includes switches for automatically setting signal states of respective manual operators of the control panel 10 to predetermined signal states. The predetermined signal states are represented by the set of control data signals SSD. The control circuit 12 is capable of providing plural sets of control data signals in a digital format representing respective tone properties of the tone signals to be generated by a tone generator 14 and outputs a set of control data signals SSD, which are designated by the preset panel 11, timewisely in serial form.

A key switch circuit 13 includes key switches corresponding to respective keys of the keyboard and supplies data representing a depressed key to the tone generator 14. In the case of a polyphonic musical instrument, the tone generator 14 has channels of a number equal to a maximum number of tones to be sounded simultaneously and the data of the depressed key is assigned to one of these channels for sounding. The serial control data signals SD outputted from the control panel 10 are supplied through the control circuit 12 to the tone generator 14. The tone generator 14 generates tone signals which are of tone pitches (notes) corresponding to respective depressed keys and are provided with tone properties as determined by the control data signals SD supplied thereto. The tone signals outputtted from the tone generator 14 is supplied to a sound system 15.

Figure 2:
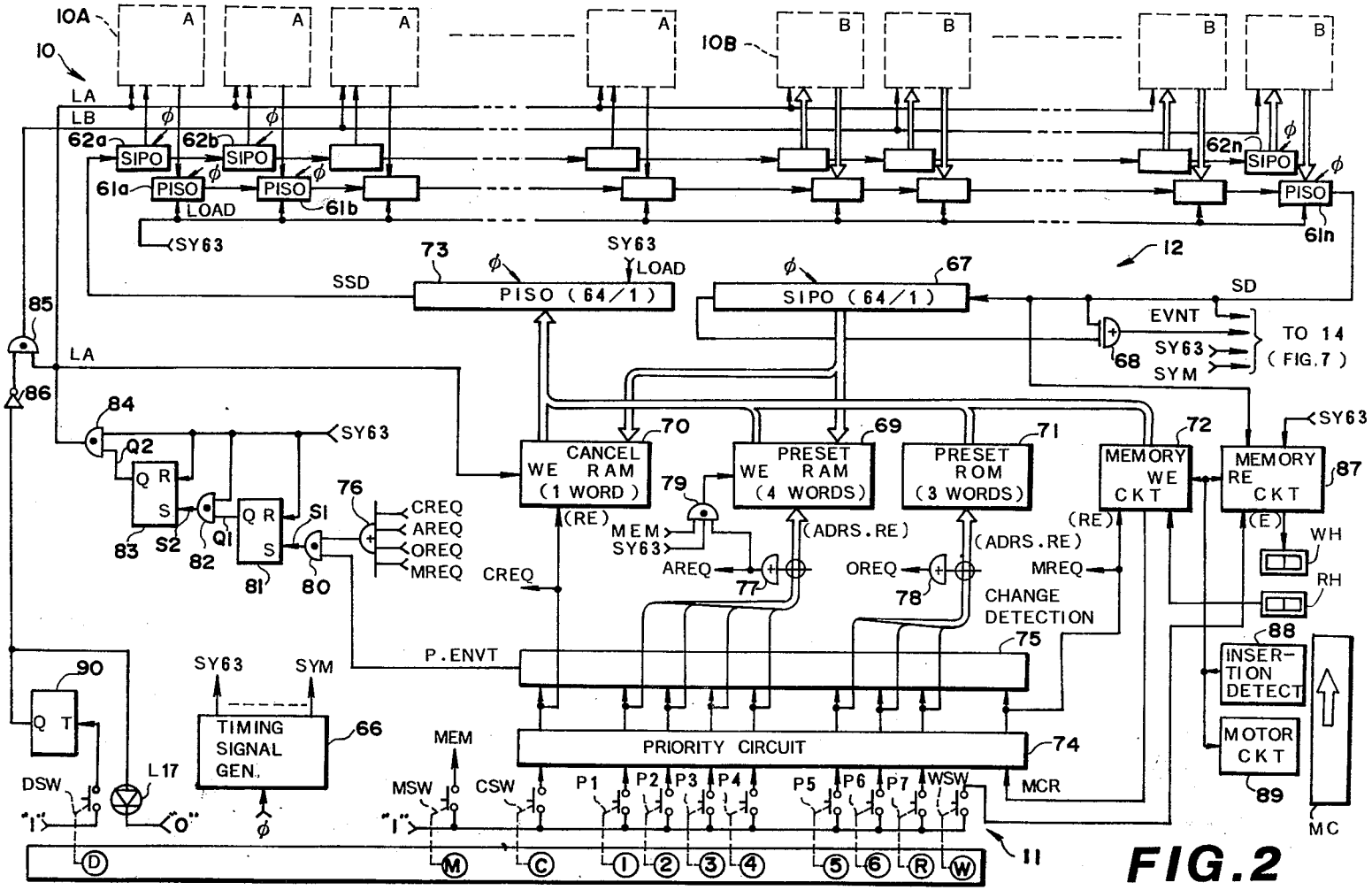
FIG. 2 is a block diagram showing a specific example of a control panel, preset panel and control circuit shown in FIG. 1.

FIG. 2 shows a specific example each of the input and output circuits of the control panel 10, the control circuit 12 and the present panel 11. In FIG. 2, illustration of details of respective manual operator units 10A . . . , 10B . . . of the control panel 10 is omitted. There are generally two types of manual operators in the control panel 10. One carries out selection of the tone color or performance effect by a single switch (hereinafter referred to as "A-type manual operator") and the other carries out selection of the tone color, tone level and performance effect stepwisely by a plurality of switches (hereinafter referred to as "B-type manual operator"). The control panel 10 includes both the A-type manual operators and the B-type manual operators.

Figure 3:
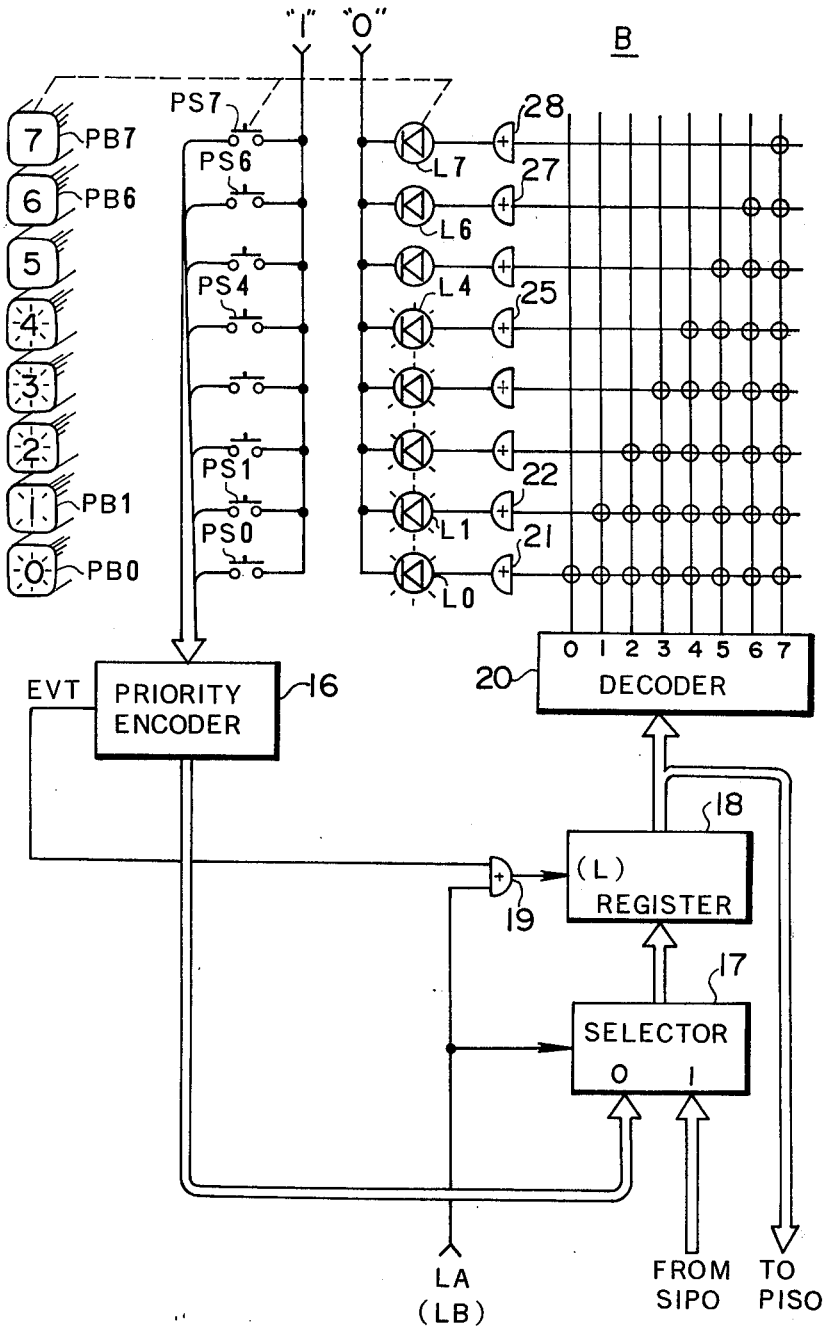
FIG. 3 is a circuit diagram showing an example of a B-type manual operator unit in a control panel shown in FIGS. 1 and 2.

FIG. 3 shows an example of the B-type manual operator unit in the control panel 10. The manual operator shown here is a tone color selection manual operator for selectively setting the tone level of a flute voice of 16-foot register (FLUTE 16') within a range of eight stages of 0 to 7. This manual operator consists of vertically arranged non-lock type push-button switches PS0–PS7 corresponding to level 0 to level 7, these push-button switches PS0–PS7 respectively having light-emitting elements (e.g., light-emitting diodes) L0–L7. Outputs of the push-button switches PS0–PS7 are applied to a priority encoder 16. The priority encoder 16 encodes a binary signal of 3 bits representing a depressed push-button switch (one of PS0–PS7). If two or more of the push-button switches are simultaneously depressed, the encoder 16 preferentially selects and encodes only one of them. The output of the encoder 16 is supplied to "0" input of a selector 17. A load signal LA (or LB) applied to a control input of the selector 17 normally is "0" and, when this selection control input signal is "0", the selector 17 selects the signal from the encoder 16 which is being applied to the "0" input. The priority encoder 16 outputs an event signal EVT when one of the push-button switches PS0–PS7 has been depressed. This event signal EVT is applied through an OR gate 19 to a load control input (L) of a register 18. The register 18 receives, when a signal "1" is supplied to the load control input (L), a code signal supplied by the selector 17. Accordingly, when one of the push-button switches PS0–PS7 has been depressed, a code signal representing the depressed push-button switch is stored in the register 18.

The output of the register 18 is applied to a decoder 20 and one of decoded outputs 0–7 is provided from the decoder 20. The output of the decoder 20 in turn is applied through one of OR gates 21–28 to one of the light-emitting elements L0–L7 corresponding to push-buttons PB0–PB7. The output (0–7) of the decoder 20 corresponds to the level of one of the push-button switches corresponding to the code signal stored in the register 18. The OR gates 21–28 is connected with the decoder 20 in such a manner that by the output of the decoder 20 which represents one of the levels "0" to "7", all of the light-emitting elements L0–L7 below that level (i.e. one or more of L0–L7) are lighted.

If, for instance, the push-button switch PS4 is depressed, a binary coded signal "100" corresponding to this switch PS4 is stored in the register 18 so that the output "4" of the decoder 20 is turned to "1". A signal "1" is thereby applied to the OR gates 21–25 respectively corresponding to the light-emitting diodes L0–L4 below the level 4 and these light-emitting diodes L0–L4 are all lighted. By lighting not only the light-emitting element of the selected level but the light-emitting elements L0–L4 corresponding to the levels below the selected level, the level can be indicated in the form of a bar-graph so that the set level can be readily recognized.

Figure 4:
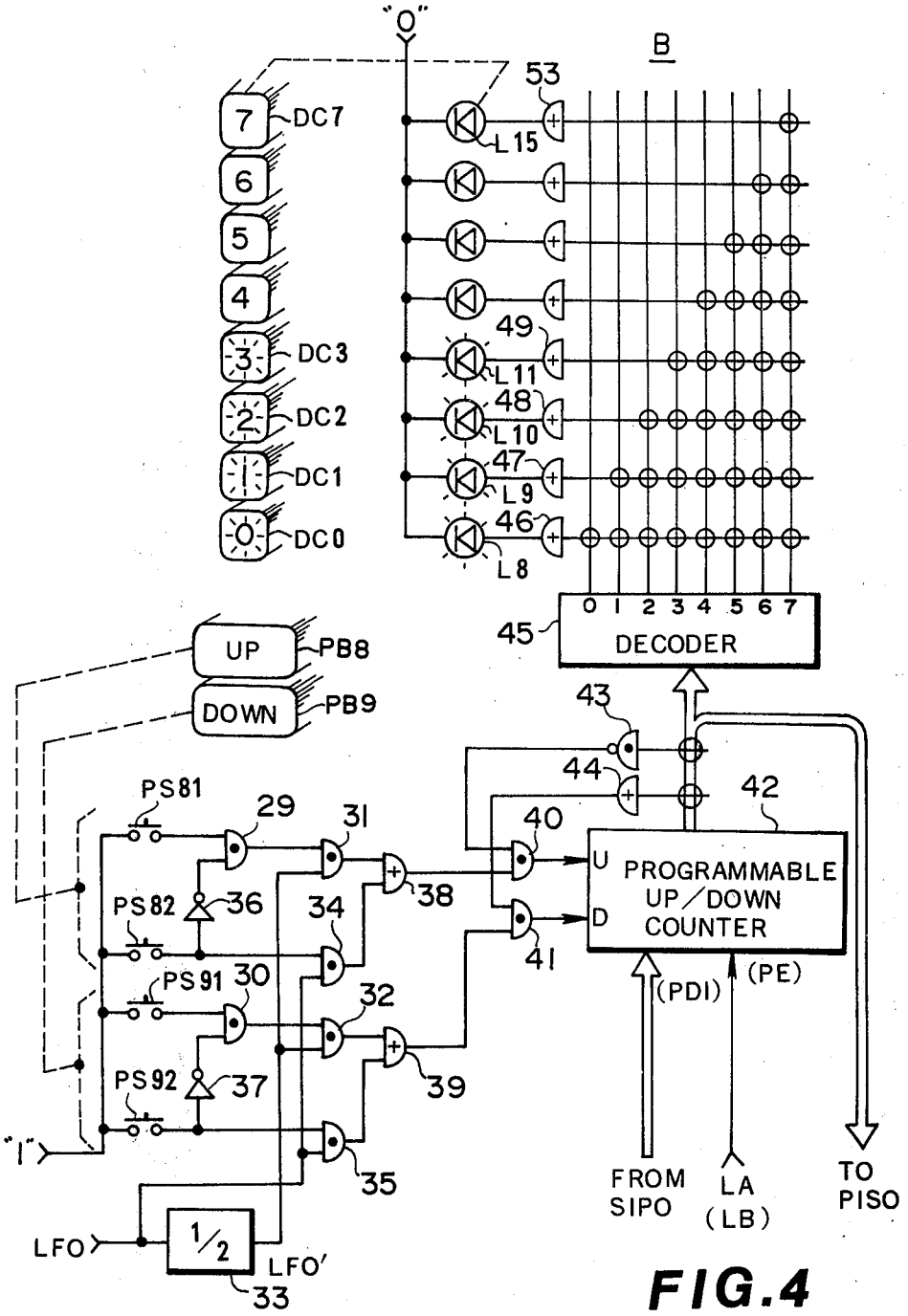
FIG. 4 is a circuit diagram showing another example of the B-type manual operator unit.

FIG. 4 is a diagram showing another example of the B-type manual operator unit in the control panel 10. Light-emitting elements L8–L15 are provided in display covers DC0–DC7 corresponding to levels 0–7. An up push-button PB8 is depressed when the set amount of, e.g., the tone level, rhythm tempo, or sustain time is to be increased whereas a down push-button PB9 is depressed when the set amount is to be decreased. Double push switches PS81, PS82, PS91 and PS92 are provided for the push-buttons PB8 and PB9. The switches PS81 and PS91 are turned on by shallow depression whereas the switches PS82 and PS92 are turned on by deep depression. If the push-button PS82 and PS92 are turned on by deep depression. If the push-button PB8 or PB9 is depressed by shallow depression, an ON output "1" of the switch PS81 or PS91 is supplied to an AND gate 29 or 30 whereby a lower-rated low frequency clock pulse LFO' obtained by two-dividing a low frequency clock pulse LFO by a two divider 33 is selected. If the push-button PB8 or PB9 is depressed deeply, an ON output "1" of the switch PS82 or PS92 is supplied to an AND gate 34 or 35 and the low frequency clock pulse LFO itself is selected. In this case, the AND gate 29 or 30 is disabled by the output of an inverter 36 or 37 so that the output of the first switch PS81 or PS91 is inhibited. The higher-rate or lower-rate low frequency clock pulse LFO or LFO' which has been selected by operating the up push-button PB8 is supplied through the AND gate 31 or 34, an OR gate 38 and an AND gate 40 to an up-count input U of a programmable up-down counter 42. The clock pulse LFO or LFO' which has been selected by operating the down push-button PB9 is supplied through an OR gate 39 and an AND gate 41 to a down-count input D of the counter 42.

Upon amounting of the count of the counter 42 to a maximum value (i.e., all "1") in up-counting, the output of a NAND gate 43 is turned to "0" whereby the AND gate 40 is disabled and the up-counting is prohibited. Upon amounting of the count of the counter 42 to a minimum value (i.e., all "0") in the down-counting, the AND gate 41 is disabled and the down-counting is prohibited.

Three bits counted from MSB in the output of the counter 42 are applied to a decoder 45 and one of decoded outputs "0" to "7" is turned to "1". As in the decoder 20 in FIG. 3, output of the decoder 45 (at any one at a time) is applied through OR gates 46–53 to the light-emitting element corresponding to that level represented by the output and to all of the light-emitting elements (one or more of L8–L15) corresponding to the levels below that level. If, for example, the output of the decoder 45 is "3", the light-emitting elements L8–L11 are lighted.

If quick increase in the set amount is desired, the up push-button PB8 is depressed deeply. The higher-rate low frequency clock pulse LFO thereby is selected through the AND gate 34 and the counter 42 counts up quickly. As the counter 42 counts up, the light-emitting elements L8–L15 are lighted one by one toward the higher level side, so that the performer may release the push-button PB8 when a light-emitting element of a desired level has been lighted. Since the lower-rate low frequency clock pulse LFO′ is selected when the push-button PB is depressed shallowly, the increasing rate of the counter 42 is slow. If, accordingly, a slow increase in the set amount is desired, the push-button PB8 should be depressed shallowly. Conversely, if a quick decrease in the set amount is desired, the down push-button PB9 is depressed deeply whereas if a slow decrease in the set amount is desired, the down push-button PB9 is depressed shallowly. As the counter 42 counts down, the light-emitting elements L8–L15 are extinguished one by one toward the lower level side so that the performer may release the push-button PB9 when light-emitting elements have been extinguished above the desired level.

In the example shown in FIGS. 3 and 4, the set amount is displayed by lighting in the manner of a bar-graph. If a single light-emitting element corresponding to the set amount only is to be lighted, each of the outputs "0" to "7" of the decoders 20 and 45 should be applied to a single light-emitting element corresponding to the output. The bar-graph type display is preferable for, e.g., the tone level for each tone color, tone level of an automatic rhythm sound, tempo of a rhythm and length of sustain time, whereas the lighting of a single light-emitting element is preferable for, e.g., a balance between the upper keyboard tones and the lower keyboard tones, and a balance between the keyboard tones and the rhythm sounds.

Figure 5:
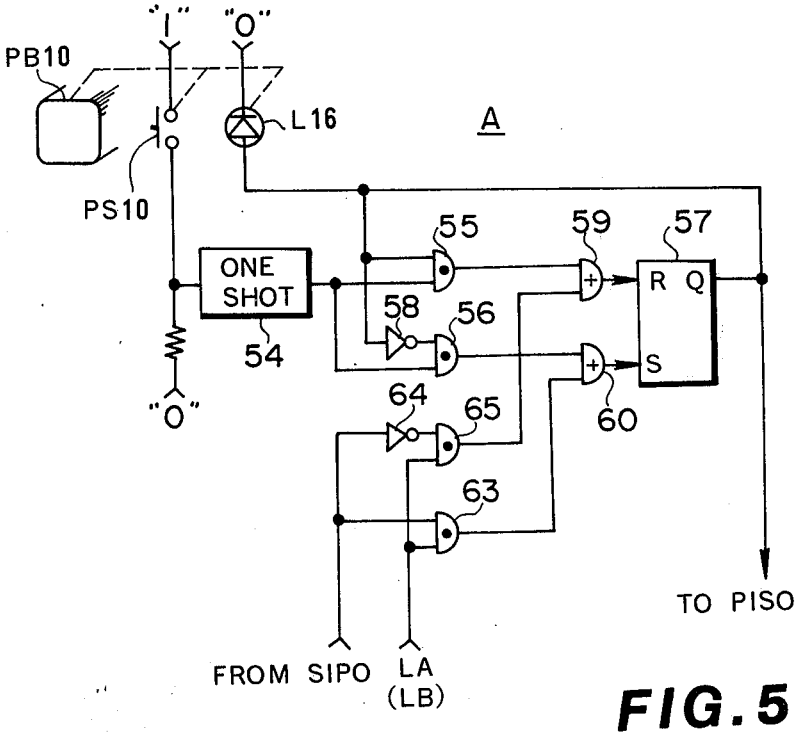
FIG. 5 is a circuit diagram showing an example of an A-type manual operator unit in the control panel.

FIG. 5 shows an example of the A-type manual operator unit in the control panel 10. The A-type manual operator unit comprises a single push-button PB10 in which a light-emitting element 16 is provided. Upon depression of the push-button switch PS10, one shot of pulse is outputted from one-shot circuit 54 and supplied to AND gates 55 and 56. An output Q of an R-S flip-flop 57 is applied to the AND gate 55 and also to the AND gate 56 after being inverted by an inverter 58. The output of the AND gate 55 is applied to a reset input R of the flip-flop 57 through an OR gate 59 whereas the output of the AND gate 56 is applied to a set input S of the flip-flop 57 through an OR gate 60. The output Q of the flip-flop 57 is applied to the light-emitting element L16. Accordingly, the state of the flip-flop 57 is inverted each time the non-lock type push-button switch PS10 is depressed whereby the light-emitting element 16 is lighted or extinguished.

In FIG. 2, outputs of the A-type manual operator units 10A etc. and the B-type manual operator units 10B etc. in the control panel 10 are converted by cascade-connected parallel-input-serial-output type (designated by PISO) shift registers 61*a* –61*n* to 1-bit serial data SD and thereafter are supplied to the control circuit 13. The control circuit 12 produces serial data SSD which is used for setting the respective operation members in the control panel 10 to predetermined states. This serial data SSD is converted by cascade-connected serial-input-parallel-output type (designated by SIPO) shift registers 62*a*–62*n* to parallel data and thereafter is applied to the respective manual operator u nits 10A etc. and 10B etc. The control circuit 12 provides the control panel 10 with a load signal LA or LB for loading the outputs of the SIPO shift registers 62*a*–62*n* into the manual operator units 10A . . . and 10B . . . at a predetermined timing.

In the B-type manual operator unit as shown in FIG. 3, a parallel code signal outputted from one of the SIPO shift registers 62*a*–62*n* is applied to a "1" input of the selector 17 and the load signal LA (or LB) is applied to the control input L of the register 18. Accordingly, when the load signal LA (or LB) is "1", the code signal outputted from one of the SIPO shift registers 62*a*–62*n* corresponding to this manual operator unit is loaded into the register 18 through the "1" input of the selector 17. In the B-type manual operator unit as shown in FIG. 4, a parallel code signal outputted from one of the SIPO shift registers 62*a*–62*n* is supplied to a preset data input PDI of a programmable up-down counter 42 and the load signal LA (or LB) is applied to a preset enable input PE of the counter 42. When, accordingly, the load signal LA (or LB) is "1", the code signal outputted from one of the SIPO shift registers 62*a*–62*n* corresponding to this unit is preset in the counter 42.

In the A-type manual operator unit as shown in FIG. 5, the output signal of one of the SIPO shift registers 62*a*–62*n* corresponding to this unit is supplied to an AND gate 63 and also to an AND gate 65 after being inverted by an inverter 64. The load signal LA (or LB) is supplied to the AND gates 63 and 65. The output of the AND gate 63 is supplied to a set input S of a flip-flop 57 through an OR gate 600 whereas the output of the AND gate 65 is supplied to a reset input R of the flip-flop 57 throygh an OR gate 59. When, accordingly, the load signal LA (or LB) is "1", the flip-flop 57 is compulsorily set if the output signal of one of the SIPO shift registers 62*a*–62*n* corresponding to this unit is "1" and compulsorily reset if the output signal is "0".

In the B-type manual operator unit as shown in FIG. 3, the output of the register 18 is applied to one of the PISO shift registers 61*a*–61*n* corresponding to this unit. In the B-type manual operator unit as shown in FIG. 4, the output of the counter 42 is applied to one of the PISO shift registers 61*a*–61*n* corresponding to this unit. In the A-type manual operator unit as shown in FIG. 5, the output of the flip-flop 57 is applied to one of the PISO shift registers 61*a*–61*n* corresponding to this unit.

It will be apparent that the shift registers 61*a*–61*n* and 62*a*–62*n* corresponding to the A-type manual operator units respectively have only one shift stage whereas the shift registers 61*a*–61*n* and 62*a*–62*n* corresponding to the B-type manual operator units respectively have the same number of stages as the bit number of the register 18 or the counter 42 of each unit.

In the present embodiment, a total bit number of output data of the entire manual operator units in the control panel 10 is 64 bits. Accordingly, total stage numbers of the PISO shift registers 61*a*–61*n* and the SIPO shift registers 62*a*–62*n* are respectively 64 stages. The shift registers 61*a*–61*n* and 62*a*–62*n* are shift-controlled by system clock pulse $\phi$. A timing signal generator 66 is provided for generating various timing signals in response to the system clock pulse $\phi$. A timing signal SY 63 is used for controlling timing of loading parallel data to the PISO shift registers 61*a*–61*n*. This timing signal SY 63 has a pulse width equivalent to one cycle of the system clock pulse $\phi$ and is generated repeatedly at a rate of one pulse for every 64 pulses of the clock pulse $\phi$.

The PISO shift registers 61*a*–61*n* receive, at their load control inputs, the timing signal SY 63 and, when this signal SY 63 is turned to "1", the various tone property control data being outputted from the operation member units are loaded to the shift registers 61*a*–61*n* in parallel. The loaded data are successively shifted through the shift registers 61*a*–61*n* and outputted from the final stage of the last shift register 61*n* as serial data SD. When time corresponding to 64 cycles of the clock pulse $\phi$ has elapsed from the time point at which the signal SY 63 was generated, the serial shift outputting of all of the data in the PISO shift registers 61*a*61*n* consisting of 64 stages has been completed. At this time, the timing signal SY 63 is generated again and parallel data is newly loaded in the registers 61*a*–61*n*. In this manner, various tone control data of 64 bits in total are repeatedly outputted after being converted to serial data.

The serial tone property control data SD is supplied to the tone generator 14 and also to a SIPO shift register 67 in the control circuit 12. This SIPO shift register 67 is a shift register of a 64-stage/1-bit type and is shift-controlled by the system clock pulse $\phi$. The shift register 67 converts the 64-bit serial tone property control data SD to parallel data and thereafter outputs it from respective stages thereof. The output of the final stage of the shift register 67 is applied to an exclusive OR gate 68. The OR gate 68 receives, at another input thereof, the serial tone control data SD, there being time delay of 64 bits between the two inputs. Accordingly, the respective data bits of the present state SD and the same of the immediately preceding state in the 64-bit tone control data are successively compared with each other in the exclusive OR gate 68. When the two states coincide with each other, i.e., there is no change in the data, the output of the exclusive OR gate 68 is "0" whereas when the two states do not coincide with each other, i.e., there is change in the data, the output of the exclusive OR gate 68 is "1". The output of the exclusive OR gate 68 is supplied to the tone generator 14 as an event signal EVNT.

The 64-bit data outputted in parallel from the SIPO shift register 67 is applied to data input terminals of a preset RAM 69 and a cancel RAM 70. The preset RAM 69 has a capacity capable of storing 4 words of the tone control data each of which consists of 64 words and the cancel RAM 70 has a capacity capable of storing 1 word of such data. A memory area of each word in the RAM 69 corresponds to one of 4 preset switches P1, P2, P3 and P4 in the preset panel 11 and is addressed by such switch. The preset switches P1–P4 are provided for writing (i.e., presetting) states of the manual operators in the control panel 10 in the RAM 69 and reading them from the RAM 69.

A preset ROM 71 prestores 3 words of data representative of the manual operators in the control panel 10, memory areas of the respective words being addressed by three preset switches P5, P6 and P7 in the preset panel 11. A memory circuit 72 reads and stores data of 1 word representing states of the manual operators in the control panel 10.

The tone control data (preset data) of 1 word read from either the RAM 69, RAM 70, ROM 71 or the memory circuit 72 is applied in parallel to a PISO shift register 73. This shift register 73 is of a 64-stage/1-bit type and is shift-controlled by the system clock pulse $\phi$, and parallel data of 1 word (64 bits) is loaded in respective stages thereof at a timing of generation of the timing signal SY 63. The tone control data (preset data) for 1 word loaded in the shift register 73 is successively outputted from the final stage in response to the clock pulse $\phi$ and inputted in series to an initial stage of the SIPO shift registers 62*a*–62*n* as serial preset data SSD. The preset data is stored in the register 18, counter 42 or flip-flop 57 of the manual operator units 10A . . . and 10B . . . in accordance with the load signal LA (or LB). Accordingly, if a preset mode is selected, the state of the preset data is dispalyed in the manual operator units 10A . . . and 10B . . . . As described previously, the control data stored in the register means such as the register 18, counter 42 and flip-flot 57 in the manual operator units 10A and 10B can be modified in its value as desired by operating the manual operators such as the push-buttons. Accoridngly, selection as to whether values of the respective preset data should be modified or not can be readily made by loading preset control data to the manual operator units 10A and 10B.

The load signal LA or LB is generated in synchronism with the timing signal SY 63. Accordingly, when the data of 64 bits loaded in the PISO shift register 73 at the time of generation of a preceding timing signal SY 63 has been transferred to the SIPO shift registers 62*a*62*n*, the load signal LA and LB are generated and data of these registers 62*a*–62*n* is loaded to the respective manual operator units 10A . . . and 10B . . . .

Outputs of a cancel switch CSW and preset switches P1–P7 in the preset panel 11 and a magnetic card reading finish signal MCR generated upon insertion of a magnetic card MC are applied to a priority circuit 74. The priority circuit 74 selectively outputs only one signal which is "1" among the inputted signals. If there are two or more input signals which are "1", only one signal "1" is selected in accordance with a predetermined order of priority. A change detection circuit 75 detects change of the output signal of the priority circuit 74 from "0" to "1" or from "1" to "0" and produces (i.e., turns to "1") an event signal P.EVNT when the circuit has detected the change. The output signal of the cancel switch CSW which has passed the priority circuit 74 is supplied to a read enable terminal of the RAM 70 and also to an OR gate 76 as a cancel request signal CREQ. The output signals of the preset switches P1–P4 which have passed the priority circuit 74 are supplied to an address input and read enable terminal (ADRS.RE) of RAM 69 and also to the OR gate 76 as an any RAM request signal AREQ after being combined through an OR gate 77. The output signals of the preset switches P5–P7 which have passed the circuit 74 are supplied an address input and read enable terminal (ADRS.RE) of ROM 71 and also to the OR gate 76 as an any ROM request signal OREQ through an OR gate 78. The magnetic card reading finish signal MCR which has passed the priority circuit 74 is supplied to a read enable terminal (RE) of the memory circuit 72 and also to the OR gate 76 as a magnetic card request signal MREQ.

A memory switch MSW provided in the preset panel 11 functions to give a load instruction to the RAM 69. An output signal MEM of this switch MSW is supplied to an AND gate 79. The AND gate 79 receives, at the other inputs thereof, the timing signal SY 63 and any RAM request signal AREA and provides its output to a write enable terminal WE of the RAM 69. In the RAM 69, the data of 64 bits outputted from the SIPO shift register 67 is written in an area designated by an address input (ADRS) when a signal "1" has been applied to the write enable terminal WE. At the timing of generation of the signal SY 63, the 64-bit data which was supplied from the control panel 10 to the PISO shift registers 61*a*–61*n* at the previous timing of generation of the signal SY 63 has all been transferred to the SIPO shift register 67. Accordingly, by controlling writing of the RAM 69 at the timing of this signal SY 3, the 64-bit data representing states of all of the operators in the control panel 10. In the RAM 69, when the signal applied to the write enable terminal WE is "0", data of 1 word (64 bits) is read from the area designated by a signal supplied to the address input and readout enable terminal (ADRS.RE).

Writing of data in the RAM 69 is effected in the following manner: The performer first manually sets the manual operators in the control panel 10 to desired states. More specifically, the performer depresses the push-buttons PB0, PB1 . . . of the operator units 10A . . . , 10B . . . as shown in FIGS. 3–5 to cause data representative of desired states to be stored in the memory circuit (register 18, counter 42 and flip-flop 57, etc.). The states of the respective operators manually set in the above described manner are visually displayed by the light-emitting elements L0, L1 . . . so that they are recognized by the player of the instrument. The data representative of the respective operators are incessantly supplied from the memory circuits (18, 42, 57) of the units 10A . . . , 10B to the SIPO shift register 67 through the PISO shift registers 61*a*–61*n*.

After setting all of the operators in the control panel 10 to the desired states, the performer depresses one of the preset switches P1–P4 for designating a desired area in the RAM 69 and also depresses the memory switch MSW. The AND gate 79 thereby is enabled at the timing of the timing signal SY 63 so that the data of the register 67, i.e., data representative of the set states of the control panel 10 is written in the area in the RAM 69 corresponding to the preset switch (one of P1–P4).

The above operation is performed with respect to each of the preset switches P1–P7 upon changing the set states of the control panel 10. Thus, four sets (4 words) of combination of the tone control data desired by the performer are stored in the entire areas of the RAM 69.

In reading data from the RAM 69 or ROM 71, one of the preset switches P1–P7 is depressed solely. Data of 64 bits thereby is read from the corresponding area in the RAM 69 or ROM 71 and loaded to the PISO shift register 73 at the timing signal SY 63.

Figure 6:
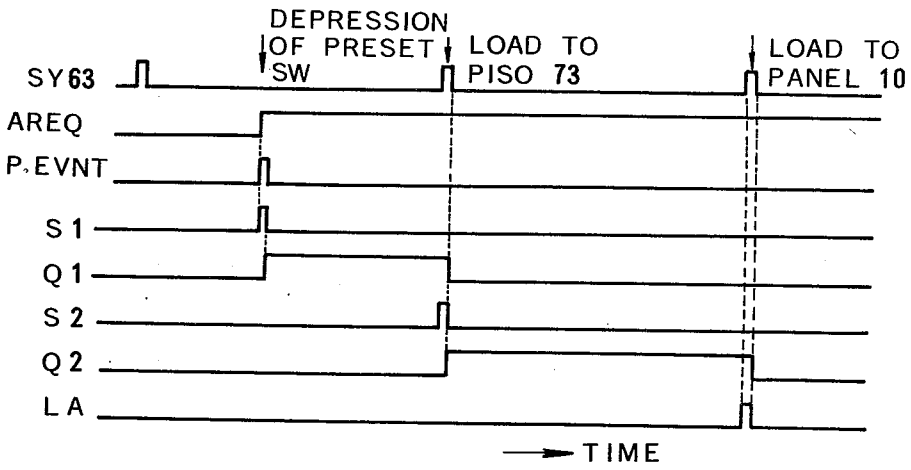
FIG. 6 is a time chart showing an example of operation of a circuit portion for providing a load signal to the control panel in FIG. 2.

If, for example, one of the switches P1–P4 for reading the RAM 69 is depressed, data of the RAM 69 is read out and the any RAM request signal AREQ is turned to "1". Besides, the event signal P.EVNT is generated as shown in FIG. 6. This event signal P.EVNT is supplied to an AND gate 80. The AND gate 80 receives, at another input thereof, the signal AREQ which is "1" via the OR gate 76. Accordingly, the output signal S1 of the AND gate 80 is turned to "1" in correspondence to the event signal P.EVNT when one of the preset switches P1–P4 has been newly depressed. The output signal S1 of the AND gate 80 is applied to a set input S of an R-S flip-flop 81. To a reset input R of the flip-flop 81 is applied the timing signal SY 63. An output signal Q1 of the flip-flop 81 therefore maintains "1" from falling of the signal S1 until falling of the signal SY 63 as shown in FIG. 6. An AND gate 82 receives the signals Q1 and SY 63. The output signal S2 thereof is generated as shown in FIG. 6. More specifically, the signal SY is turned to "1" in synchronism with generation of first timing signal SY 63 (FIG. 6) counting from the depression of one of the preset switches P1–P4. At this time, the data read from the RAM 69 is loaded in the PISO register 73.

The signal S2 is applied to a set input S of an R-S flip-flop 83 of a set priority type. To a rest input R of the flip-flop 83 is applied the timing signal SY 63. Accordingly, an output signal Q2 of this flip-flop 83 maintains "1" during 64 time slots (1 time slot being one period of the clock pulse $\phi$) from falling of the signal S2 until falling of the signal SY 63 as shown in FIG. 6. This output signal Q2 and the timing signal SY 63 are applied to an AND gate 84 which, as shown in FIG. 6, produces the load signal LA. More specifically, the load signal LA is produced when 64 time slots have elapsed since loading of the data newly read from the RAM 69 in the PISO register 73. Accordingly, the load signal LA is produced when preset data for 64 bits selected by one of the switches P1–P4 has been transferred to the SIPO registers 62*a*–62*n* and the preset data is supplied to the corresponding manual operator units 10A . . . and 10B . . . . Either the load signal LA or LB is applied to the manual operator units 10A . . . , 10B . . . and the load signal LB usually is the same as the load signal LA. An AND gate 85 which outputs the signal LB is usually enabled by an output signal "1" of an inverter 86 so that the signal LB is generated in response to the signal LA applied to the other input. Difference between the signal LA and the signal LB will be described later.

In reading data from the ROM 71, RAM 70 or memory circuit 72 by manipulating the switches P5–P7 or CSW or inserting the magnetic card MC, the load signal LA is produced, similarly as in the above described case, after lapse of 64 time slots from loading of the read out data in the PISO register 73 and the data is supplied to the manual operator units 10A . . . , 10B . . . . In the same manner as was previously described, the AND gate 80 is enabled by generation of the event signal P.EVNT at the time of change of the outputs of the switches or change of the signal MCR and by generation of the request signals CREQ, OREQ and MREQ in response to the outputs of the switches or the signal MCR and thereupon the load signal LA is produced.

In the above described manner, a set of the control data signals which have been loaded to the manual operator units 10A, 10B of the control panel from the side of the preset panel 11 are held in the register means (e.g., 18, 42, 57) in the respective units and also applied to the tone generator section 14 after being converted to the serial control data SD through the PISO registers 61*a*–61*n*. Each of the present control data signals once held in such register means in the manual operator units 10A, 10B can be freely modified or not modified by the selective operation of the manual operators.

Among the three preset switches P5–P7 corresponding to the ROM 71, the switches P5 and P6 function to select preset data for generating tones in a desired state whereas the preset switch P7 functions to select data for resetting the control panel 10 to an initial state. By depressing this switch P7, data for setting set levels of the respective manual operators to 0, the tone volume balance to a middle point and respective tonal effects to an off state is read from the ROM 71 and the manual operators of the control panel 10 are thereby set to an initial state. The setting of the respective manual operators therefore can be achieved by a single manual operation.

The cancel RAM 70 is provided for storing the state set in the control panel 10 immediately before preset data read from the RAMs 69 or 70, the ROM 71 or the memory circuit 72 is loaded in the control panel 10. To a write enable terminal (RE) of this RAM 70 is applied the load signal LA outputted from an AND gate 84. When the preset data is written in the control panel 10 in response to this load signal LA, the data representing the immediately preceding set state in the control panel 10 is being stored in the SIPO register 67. Accordingly, upon generation of the load signal LA, the data representing the immediately preceding set state in the control panel 10 is written in the RAM 70.

This cancel RAM 70 is used for cancelling the preset data stored in the control panel 10 and returning the state of the control panel 10 to a state immediately before storing the preset data. The cancel RAM 70 is effectively utilized in a case, for example, where data to be written in the preset RAM 69 (or magnetic card MC) is selectively set in the control panel 10 or the performance mode is to be returned from the preset mode to the manual mode. A typical process for forming data to be written in the RAM 69, i.e., forming a desired tone, will now be described.

The state of the control panel 10 is reset by depressing the switch P7. Nextly, the manual operators in the control panel 10 are manually set to desired states. Data representing the manually set operators is outputted as serial data SD and applied to the SIPO register 67. The manually set states can be visually confirmed by lighting of the light-emitting elements L0, L1, etc. in the control panel 10. Since this data SD is applied also to the tone generator 14, the manually set tone control states can be acoustically confirmed by sounding a tone by depression of a suitable key. Then, a desired one of the preset switches P1–P6 is depressed for comparing stationary preset data stored in the ROM 71 with the manually set data. A set of preset data is read from the RAM 69 or ROM 71 and loaded in the PISO register 73. After lapse of 64 time slots, the load signal LA is generated and thereupon the preset data transferred from the PISO register 73 to the SIPO registers 62*a*–62*n* is written in the control panel 10 and the manually set data in the SIPO register 67 is simultaneously stored in the RAM 70. The contents of the preset data can be visually confirmed by the lighting display in the control panel 10 and also acoustically confirmed by actually sounding tones. After comparing the preceding manually set contents with the preset contents, the performer depresses the cancel switch CSW. The preceding manually set contents is thereupon read from the cancel RAM 70 and loaded in the PISO register 73. Simultaneously, The load signal LA is generated in response to the signals P·EVNT and CREQ and the preceding manually set data transferred from the PISO register 73 to SIPO registers 62*a*–62*n* is stored in the control panel 10. The preset data in the control panel 10 thereby is cancelled and the state in the panel 10 is returned to the manually set state immediately before storing the preset data. The performer adjusts the manually set contents in the control panel 10 on the basis of comparison of the manually set contents with the preset data. Upon finally determining the manually set state in the control panel, the performer depresses the memory switch MSW and a desired one of the preset switches P1–P4 simultaneously and causes the preset RAM 69 to store the state of the desired preset switch.

In a case where performance according to the preset mode is inserted in the performance, the state in the control panel 10 immediately before the preset switch P1–P6 are manipulated is stored in the RAM 70 and, accordingly, the control panel 10 can be conveniently restored to the state immediately before the insertion of the preset mode by depression of the cancel switch CSW.

A write switch WSW is provided in the preset panel 11 for writing data in the magnetic card MC. A memory circuit 87 receives the serial data SD representing the set state in the control panel 10 and stores it after converting it to parallel data at the timing of the timing signal SY 63. The output of the write switch WSW is applied to an enable input (E) of the memory circuit 87. A magnetic card insertion detection circuit 88 is provided for detecting insertion of the magnetic card MC and thereupon driving a motor circuit 89 to withdraw the magnetic card MC toward heads WH and RH and thereafter return the card MC. The output of the insertion detection circuit 88 is supplied also to a read enable terminal (RE) of the memory circuit 87 and a write enable terminal (WE) of the memory circuit 72. The memory circuit 87 provides the stored data (i.e., data representing the present set state of the control panel 10) to the write head WH on the condition that the magnetic card MC has been inserted after depression of the write switch WSW. The state of the control panel 10 can be written (preset) in the magnetic card MC in the above described manner.

In a case where the contents stored in the magnetic card MC is set in the control panel 10, the card MC is inserted without any other operation. The contents stored in the magnetic card MC read by the read head RH is stored in the memory circuit 72. Upon completion of the reading, the memory circuit 72 produces a mangetic card reading finish signal MCR which is supplied to a read enable terminal (RE) of the memory circuit 72 through the priority circuit 74. Simultaneously, the event signal P.EVNT and the card request signal MREQ are produced and, responsive to these signals, the load signal LA is generated. Accordingly, the data of the magnetic card MC stored in the memory circuit 72 is read from the circuit 72 and stored in the control panel 10 via the PISO register 73 and SIPO registers 62*a*–62*n*.

A disable switch DSW is provided in the preset panel 11 for disabling change of data in a predetermined manual operator unit in writing the preset data read from the RAM 69, 70, ROM 71 or memory circuit 72 in the control panel 10. The output of the switch DSW is applied to a T flip-flop 90 which effects ½ frequency dividing operation. The state of this flip-flop 90 is inverted to "1" or to "0" each time the switch DSW is depressed. This output is supplied to the light-emitting elements L17 and also to an AND gate 85 through an inverter 86. The output of the T flip-flop normally is set to "0". In this case, the output of the inverter 86 is "1" and the AND gate 85 is enabled. Accordingly, the load signal LB as well as the load signal LA is generated and contents of all of the manual operator units in the control panel 10 are rewritten by the preset data at the time of generation of the load signal LA. At this time, the light-emitting element L17 is in an off state, indicating that rewriting of a part of the data is not prohibited.

If it is desired to prohibit rewriting of a part of the data, the disable switch DSW is depressed when the light-emitting element L17 is not lighted. The T flip-flop 90 thereby is turned to "1", the light-emitting element L17 is lighted and the output of the inverter 86 is turned to "0" disabling the AND gate 85. In this state, the load signal LB is not generated but remains "0" even if the load signal LA is generated (i.e., turned to "1"). Accordingly, in case the preset data read from the RAM 69 ro 70, ROM 71 or memory circuit 72 is written in the control panel 10 at the timing of generation of the load signal LA, no preset data is written in a manual operator unit to which the load signal LB, instead of the load signal LA, is applied, so that such manual operator unit continues to hold the old set state. For releasing the manual operator unit from the rewriting prohibition state, the disable switch DSW should be depressed when the light-emitting element L17 is lighted.

Tone control factors for which rewriting should be prohibited by the disable switches DSW may be selected as desired. An automatic rhythm section (rhythm type and tempo), for example, which does not generally change in a piece of music is a suitable factor. By such rewriting prohibition control, operation of desired preset data during the manual setting operation or during the performance can be facilitated. Besides, variation in the preset data can be readily formulated resulting in broadening of the kind of the present data.

Since, as described above, the light-emitting elements L0, L1 . . . indicating the set states of the respective manual operators in the control panel 10 are lighted by outputs of the memory circuits inside the manual operators (register 18, counter 42, flip-flop 57, etc.) and the manually set data and the preset data are stored in these memory circuits, contents of the respective preset data can be visually displayed by manual operator units corresponding to the respective data.

The various manually set or preset tone control data stored in the memory circuits (18, 42, 57) in the respective manual operator units are converted, as described above, to serial data SD and thereafter supplied to the tone generator 14. The tone generator 14 receives also the event signal EVNT outputted by the exclusive OR gate 68, the timing signal SY 63 and a suitable timing signal SYM outputted from the timing signal generator 66.

Figure 7:
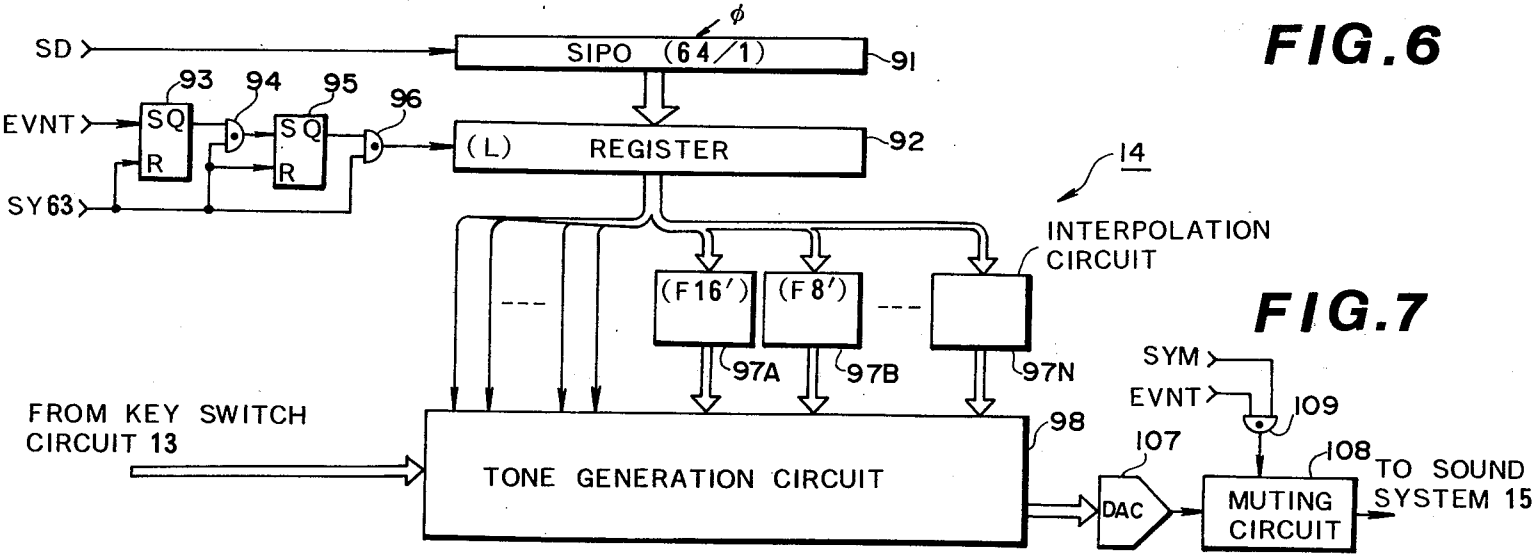
FIG. 7 is a block diagram showing a tone generator.

In the tone generator 14 shown in FIG. 7, the tone control data which has been concerted to serial 64-bit data is applied to a 64-stage 1-bit SIPO register 91. Outputs of all stages of the SIPO register 91 are applied in parallel to a register 92. On the other hand, the event signal EVNT is applied to a set input S of an R-S flip-flop 93. The timing signal SY 63 is applied to reset inputs of the flip-flop 93 and a flip-flop 95 and also to AND gates 94 and 96. These flip-flops 93 and 95 and AND gates 94 and 96 are connected and operate in the same manner as the flip-flops 81, 83 and AND gates 82 and 84. When any bit of the serial data SD had changfd, the event signal EVNT is turned to "1" at a time slot corresponding to this bit and the flip-flop 93 thereby is set. At a timing of a nextly arriving timing signal SY 63, the flip-flop 95 is set and at a timing of a further timing signal SY 63, the output of the AND gate 96 is turned to "1". The output of this AND gate 96 is applied to a load control input (L) of the register 92. Accordingly, when states of storage in the memory circuits (18, 42 and 57) in the control panel 10 have changed, data representing new states after the change is loaded from the SIPO register 91 to the register 92.

A part of the 64-bit tone control data stored in the register 92 is supplied to a tone generation circuit 98 through interpolation circuits 97A, 97B, . . . 97N and the remaining part of the tone control data is directly supplied to the tone generation circuit 98. The interpolation circuits 97A–97N are provided corresponding to various data which can be adjusted in several small steps, e.g., the tone level. For example, the interpolation circuits 97A–97N are provided for tone level set data or tone level balance set data for respective tones colors such as flute voice of 16-foot register (F16') and flute voice of 8-foot register (F8'). When set data of tone color or tone level has been changed, these interpolation circuits 97A–97N serve to interpolate smoothly a gap between a level before the change and a level after the change thereby mitigating an abrupt change in the set level with resulting prevention of clicking.

Figure 8:
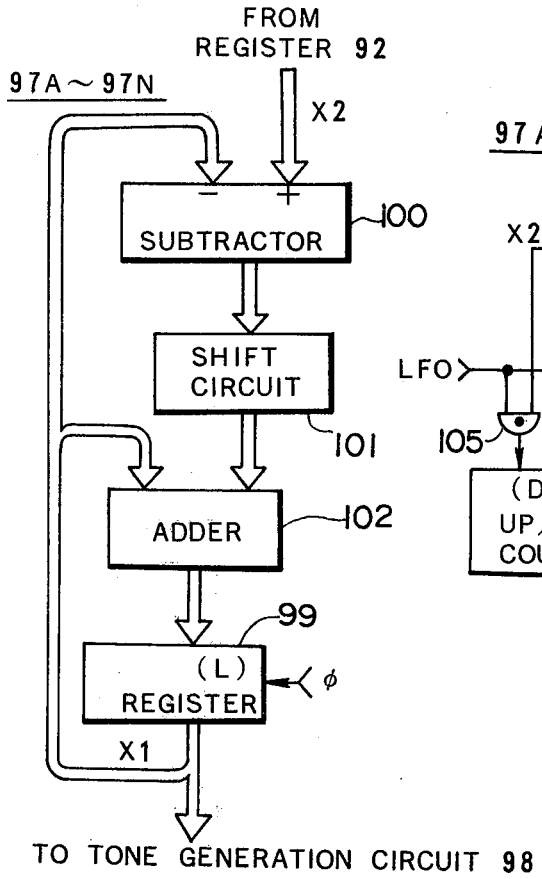
FIG. 8 is a block diagram showing an example of an interpolation circuit in FIG. 7.
Figure 9:
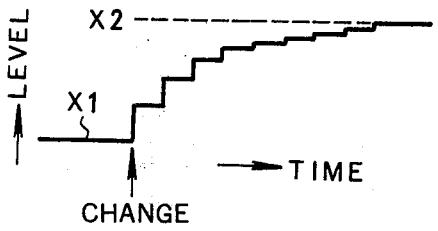
FIG. 9 is a graphical diagram showing the interpolation operation by the interpolation circuit in FIG. 8.

FIG. 8 shows an example of the interpolation circuits 97A–97N according to which a gap between the level before the change and the level after the change is logarithmically interpolated. An output register 99 stores level data X1 (present level data) supplied finally to the tone generation circuit 98. When new level data X2 is initially supplied from the register 92 (FIG. 7), the level data X1 of this output register 99 exhibits the level before the change. A subtractor 100 effects subtraction of "X2−X1" and a shift circuit 101 shifts difference "X2−X1" to scale it down to a small value $(X2-X1)/2^n$. An adder 102 adds the small value outputted from the shift circuit 101 to the level data X2 and a result of the addition is loaded in the register 99 at a timing of the system clock pulse $\phi$. As shown in FIG. 9, difference between the level data X1 and X2 is at the maximum immediately after the level data has been changed so that the small value supplied from the shift circuit 101 to the adder 102 is of a relatively large value. The value of the data X1 changes at a timing of the clock pulse $\phi$ and approaches the data X2 by the small value given by the shift circuit 101. As the difference between the data X1 and X2 becomes smaller, the small value supplied from the shift circuit 101 to the adder 102 also becomes smaller so that rate of change of the data X1 becomes smaller. In this manner, the level data X1 outputted from the register 99 changes in such a manner that the gap between the level data before the change and the level data X2 after the change will be logarithmically interpolated. When the data X1 has finally become equal to the data X2, outputs of both the subtractor 100 and the shift circuit 101 are turned to "0" and the level data X1 which is equal to the level data X2 is circulatingly stored and held in the adder 102 and the register 99. When the level data X2 is smaller than the level data X1, the output of the subtractor 100 is of a negative value in which case the adder 102 substantially effects subtraction.

Figure 10:
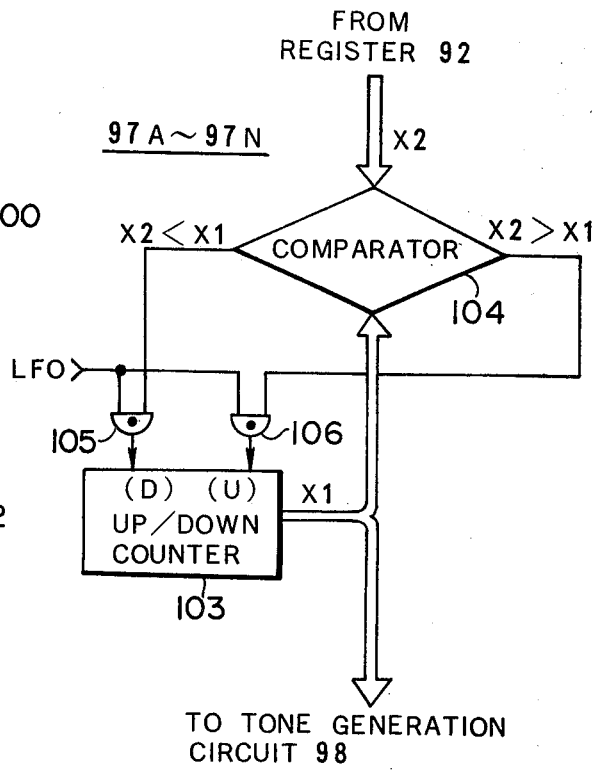
FIG. 10 is a block diagram showing another example of the interpolation circuit in FIG. 7.
Figure 11:
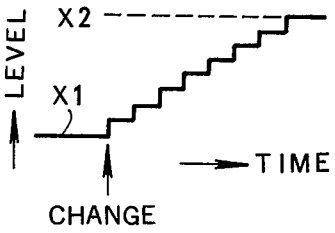
FIG. 11 is a graphical diagram showing the interpolation operation by the interpolation circuit in FIG. 10.

FIG. 10 shows another example of the interpolation circuits 97A–97N according to which the gap between the level before the change and the level after the change is linearly interpolated. The level data X1 outputted from an up-down counter 103 is supplied to the tone generation circuit 98. A comparator 104 compares the level data X2 provided by the register 94 (FIG. 7) with the level data X1 and supplies "1" to an AND gate 105 if the data X2 is smaller than the data X1, i.e., the level is changed in the direction of a smaller level and supplies "1" to an AND gate 106 if the data X2 is larger than the data X1, i.e., the level is changed in the direction of a larger level. Upon enabling of the AND gate 105 by the signal "1" from the comparator 104, a low frequency clock pulse LFO is applied to a down count input (D) of a counter 103 whereby the data X1 gradually decreases at a constant rate toward the data X2. Upon enabling of the AND gate 106 by the signal "1" from the comparator 104, the low frequency clock pulse LFO is applied to an up count input (U) of the counter 103 whereby the data X1 gradually increased toward the data X2. When the data X1 at last becomes equal to the data X2, the AND gates 105 and 106 are disabled to cause the counter 103 to stop its counting operation and hold the state X1=X2. FIG. 11 shows an example of the linear interpolation in the case of X2>X1.

The interpolation circuits 97A–97N are not limited to the above described examples but other suitable construction may be adopted. For instance, a ROM storing a predetermined interpolation function may be provided and interpolation may be effected in accordance with this interpolation function.

The tone generation circuit 98 outputs a tone signal of a tone pitch determined on the basis of data of the depressed key provided by the key switch circuit 13 (FIG. 1), which tone signal has been controlled in tone pitch, tone color, tone level and the like according to the tone control data supplied by the register 92 and the interpolation circuits 97A–97N. Any tone generation system may be employed in this tone generation circuit. Circuits providing musical effects such as an automatic rhythm performance circuit is included in the tone generation circuit 98.

Since the tone level data has been supplied to the tone generation circuit 98 through the interpolation circuits 97A–97N, an abrupt change in the set level in the control panel 10 is not followed by an actual change in the tone level which changes gradually and smoothly. It should be noted that the type of level data which should be passed through the interpolation circuits 97A–97N is not limited to the tone level but any other level data for which an abrupt change is undesirable may be passed through these interpolation circuits.

In a case where the tone generation circuit 98 generates a digitalized tone signal, its output signal is applied to a digital-to-analog converter (DAC) 107 for conversion to an analog tone signal. This analog tone signal is supplied to a sound system 15 (FIG. 1) through a muting circuit 108.

The muting circuit 108 is provided for achieving the same object as the interpolation circuits 97A–97N. The muting circuit 108 causes the tone level to decrease temporarily when, with respect to any of the operation members of the control panel 10 for which an abrupt change in the set level affects the tone adversely, the set level of the operation member has been changed. The event signal EVNT outputted from the exclusive OR gate 68 and a mute timing signal SYM outputted from the timing signal generator 66 shown in FIG. 2 are supplied to an AND gate 109 and, when the output signal of the AND gate 109 has been turned to "1", the muting circuit 108 starts the muting operation.

The mute timing signal SYM is generated (i.e., turned to "1") in synchronism with a time slot among 64 bit time slots of the serial tone control data SD to which set data of an operation member for which an abrupt change in the set state adversely affects the tone (e.g. the operation member for setting a tone level with respect to each tone color or the operation member for setting tone level balance). The event signal EVNT is generated, as was described previously, in synchronism with a time slot for the bit whose value has changed in the 64-bit data SD. If, accordingly, the set state of the operation member for which an abrupt change in the set state adversely affects the tone has undergone even a slight change, the AND gate 109 is enabled and the muting operation of the muting circuit 108 is implemented.

Figure 12:
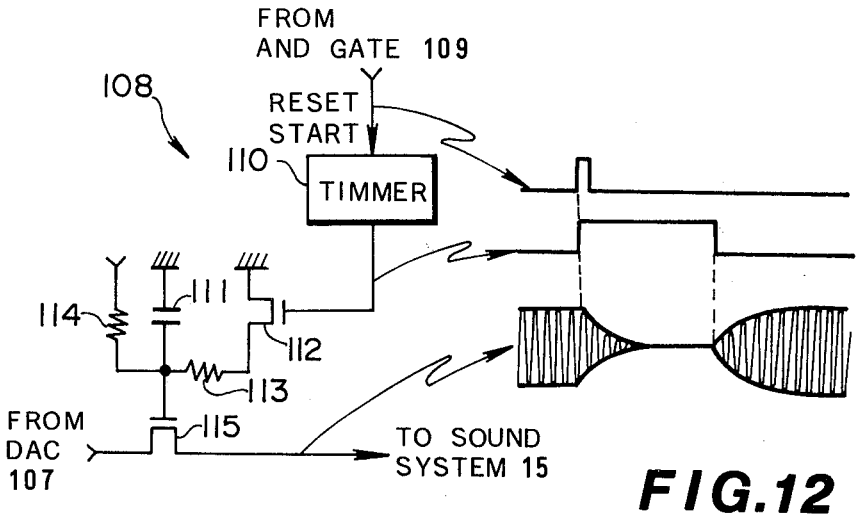
FIG. 12 is a circuit diagram showing an example of a muting circuit in FIG. 7.

FIG. 12 shows an example of the muting circuit 108. The output signal of the AND gate 109 is applied to a reset-start input of a timer 110. When, as described above, the AND gate 109 has been enabled and the output thereof has been turned to "1", the timer 110 is reset to its initial state and starts time counting operation. The timer 110 outputs a signal "1" during a certain period of time from starting of time counting operation. A capacitor 111 is normally charged and is discharged through a resistor 113 when an FET gate 112 is enabled by an output signal "1" of the timer 110. Upon turning of the output signal of the timer 110 to "0", the FET gate 112 is closed and the capacitor 111 is charged through the resistor 114. The analog tone signal outputted from the digital-to-analog converter 107 is supplied to the sound system 15 through the FET gate 115. This FET gate 115 is controlled according to terminal voltage of the capacitor 111. Accordingly, when the set state of the manual operator for which an abrupt change in the set state is likely to affect the tone adversely has changed, the tone signal is muted smoothly according to the discharge waveform of the capacitor 111 during a certain period of time set by the timer 110 and thereafter increases smoothly according to the charge waveform of the capacitor 111.

If the interpolation circuits 97A–97N are not provided, a tone signal accompanied by clicking is outputted from the tone generation circuit 98 when an abrupt change has occurred in the set level of any of the manual operator. The tone signal, however, is muted or weakened through the muting circuit 108 by the operation of the timber 110 so that the tone signal accompanied by clicking is not sounded. Since the interpolation circuits 97A–97N and the muting circuits 108 function to achieve the same object, it will suffice if either one of them is provided.

The tone property control data to be controlled by the interpolation circuits 97A–97N and the muting circuit 108 is not limited to data for which setting of level in a plurality of stages is possible but it may be data of a two-state selection type, i.e., two states of ON and OFF. For example, occurrence of clicking in turning on or off of a tone color can be effectively prevented. The muting circuit 108 may be so constructed that it is operated by manipulation of a switch on the preset panel 11.

In a case where tone is to be generated in a plurality of systems, the muting circuit 108 may be provided in each system and only the muting circuit 108 in a system corresponding to a manual operator the set state of which has been changed may be operated.

Figure 13:
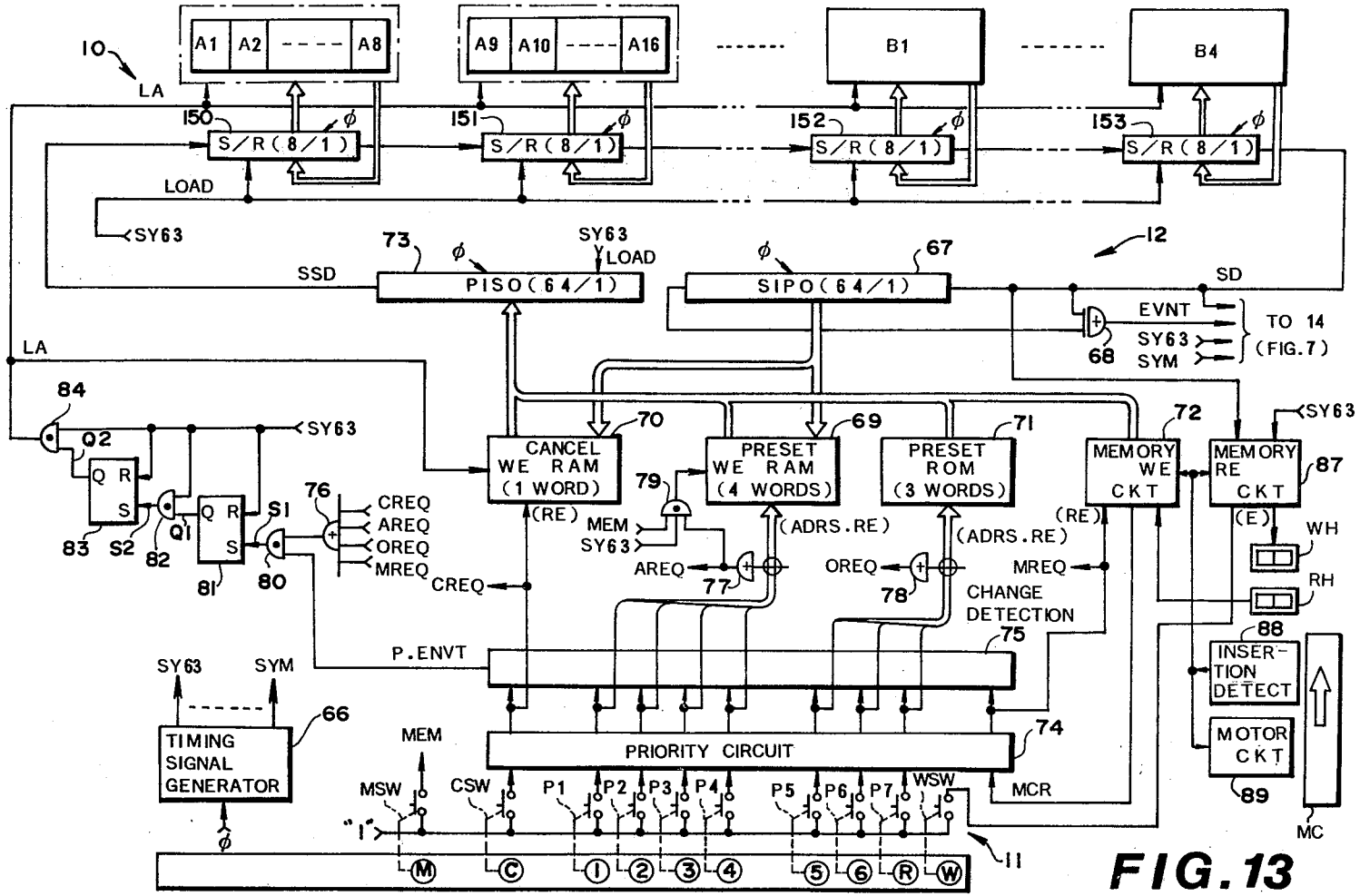
FIG. 13 is a block diagram showing a modified example of the control panel, preset panel and the control circuit of FIG. 1.

FIG. 13 shows a modified example of the circuitry shown in FIG. 2, particularly that of the input and output circuitry in the control panel 10. In the control panel 10 of FIG. 2, the SIPO registers 62*a*–62*n* for inputting data and the PISO registers 61*a*–16*n* for outputting data are separately provided. These data inputting and data outputting registers may, however, be formed by common registers as shown in FIG. 13. In FIG. 13, the portions of the control circuit 12 and the preset panel 11 are the same as those of FIG. 2 and the same component parts in these portions in FIG. 13 are designated by the same reference numerals as those used in FIG. 2. It should be noted, however, that the circuit relating to the disable switch DSW, i.e., the circuit for generating the load signal LB, is omitted in FIG. 13 for convenience of illustration and the respective manual operator units are shown as being controlled by the load signal LA. The circuit relating to the load signal LB as shown in FIG. 2 may, however, be provided in the circuit shown in FIG. 13.

In the control panel 10 of FIG. 13, each of two groups of eight A-type manual operator units A1–A8 and A9–A16 is shown by one block and 8-stage/1-bit shift registers 150 and 151 are provided for the respective blocks. By way of example, four B-type manual operator units B1–B4 are provided and control data corresponding to each of these units is 8-bit data. Accordingly, 8-stage/1-bit shift registers 150–153 are provided in correspondence to these B-type manual operator units B1–B4. Although not illustrated, other A-type and B-type manual operator units and corresponding shift registers are also provided. The respective shift registers 150–153 are cascade-connected, constituting, as a whole, a shift register of 64-stage/1-bit. The serial control data signal SSD outputted from the PISO register 73 is applied serially to the first stage of the shift register 150. The parallel control data signals outputted from the manual operator units A1–A16 and B1–B4 are applied to the respective stages of the corresponding shift registers 150–153. The timing signal SY 63 is applied to the load control inputs of the respective shift registers 150–153, as in the previously described PISO registers 61*a*–61*n*. When the control data is written in the respective manual operator units A1–A16 and B1–B4, the shift registers 150–153 function as a serial to parallel conversion circuit. More specifically, when the serial control data signals SSD supplied by the PISO register 73 have entered all stages of the shift registers 150–153, the load signal LA is generated as shown in FIG. 6 and these control data signals are loaded in parallel to the manual operator units A1–A16 and B1–B4. On the other hand, the parallel control data signals outputted from the manual operator units A1–A16 and B1–B4 are loaded in the respective stages of the shift registers 150–153 at the timing of generation of the timing signal SY 63 and are outputted as serial control data signals from the last stage of the last shift register 153. In this way, the shift registers 150–153 function as the parallel to serial conversion circuit. Since the load signal LA and the timing signal SY 63 are generated simultaneously, the timing of loading the parallel outputs of the shift registers 150–153 to the manual operator units A1–A16 and B1–B4 are simultaneous with the timing of loading the parallel outputs of these manual operator units to the shift registers 150–153. As is well known, however, the input timing of registers and shift registers has some time delay to the output timing thereof so that there is no problem at all.

Figure 14:
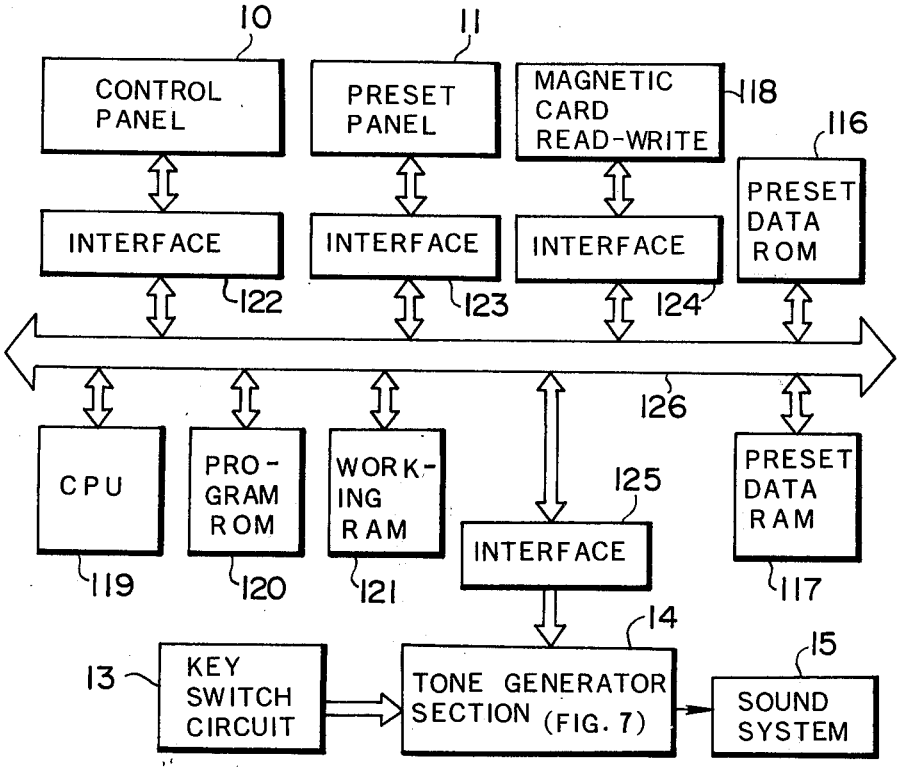
FIG. 14 is a block diagram showing schematically an entire construction of another type of electronic musical instrument embodying the present invention.

In the above described embodiment, the control circuit 12 is composed of hard wired logics. The control circuit 12 may however be composed of a microcomputer. FIG. 14 shows an example of employing a microcomputer for the control circuit 12.

In FIG. 14, reference characters 10–15 designate the same circuit devices as designated by the same reference characters in FIG. 1. A preset ROM 116 and a RAM 117 perform the same functions as the ROM 71 and RAM 69 in FIG. 2. A magnetic card write and read section 118 corresponds to the portion including the head WH and RH and the circuits 88 and 89. Reference characters 119 designated CPU (central processing unit), 120 a program ROM and 121 a working RAM respectively. As a device corresponding to the cancel RAM 70, a part of the preset data RAM 117 or the working RAM 121 may be employed. Reference characters 122–125 designate an interphase section. Data is transferred between each unit through a common bus 126.

Figure 15:
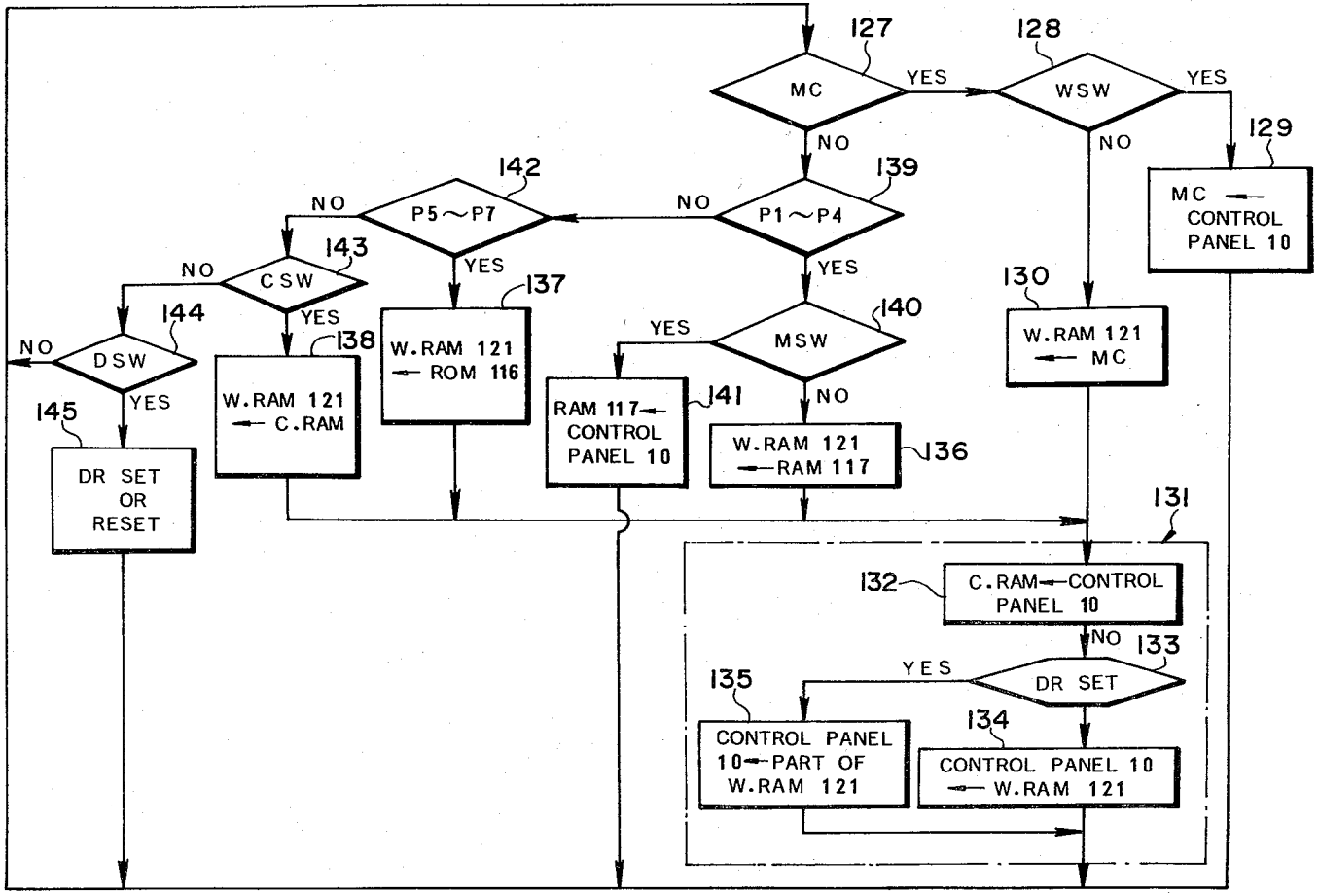
FIG. 15 is a flow chart showing an example of processing carried out by a microcomputer in FIG. 13.

The same control as has been described with reference to FIGS. 1–13 can be performed by using the microcomputer type electronic musical instrument of the above described construction. A program for implementing the same processing as has been described with reference to FIGS. 1–13 is stored in the program ROM 120 and this program is implemented under the control of the CPU 119. An outline of implementation of the program will now be briefly described with reference to FIG. 15. First, in step 127, whether the magnetic card has been inserted or not is examined. If the answer is YES, step 128 is carried out. In step 128, whether the write switch WSW of the preset panel 11 has been depressed or not is examined. If step 128 is YES, the processing proceeds to step 129 where the state of the control panel 10 is written in the magnetic card MC. If the answer is NO, the processing proceeds to step 30 where the data stored in the magnetic card MC is read and stored temporarily in the working RAM (W.RAM) 121. Then the processing proceeds to routine 131 where steps 132–135 are carried out.

In step 132, the state of the control panel 10 is written in a cancel RAM section (C.RAM) of the preset data RAM 117. In step 133, whether the register DR which is controlled in inversion by the disable switch DSW of the preset panel 11 is in a set state or not is examined. The processing proceeds to step 134 if the answer is NO, and to step 135 if the answer is YES. In step 134, the 64-bit preset data which was temporarily stored in the working RAM 121 in step 130 (or 136, 137, 138) immediately before routine 131 is written in the control panel 10. In step 35, a predetermined portion of the 64-bit preset data temporarily stored in the working RAM 121 is written in the control panel 10.

If step 127 is NO, the processing proceeds to step 139 in which whether the preset switches P1–P4 for the RAM have been depressed or not is examined. If step 127 is YES, the processing proceeds to step 140 in which whether the memory switch MSW has been depressed or not is examined. If step 140 is YES, the processing proceeds to step 141 in which the state of the control panel 10 is written in a RAM section in the preset data RAM 117 selected by one of the switches P1–P4. If step 140 is NO, the processing proceeds to step 136 in which the data stored in the RAM 117 selected by one of the switches P1–P4 is read out and temporarily stored in the working RAM 121. Routine 131 thereafter is carried out.

If step 139 is NO, the processing proceeds to step 142 in which whether any of the preset switches P5–P7 for ROM has been depressed or not is examined. If step 142 is YES, the processing proceeds to step 137 whereas if step 142 is NO, the processing proceeds to step 143. In step 137, the preset data ROM 116 selected by one of the switches P5–P7 is read and the read out data is temporarily sotred in the working RAM 121 and routine 131 thereafter is carried out.

In step 143, whether the cancel switch CSW has been depressed or not is examined. If step 143 is YES, step 138 is carried out. In step 138, data stored in the cancel RAM section (C.RAM) is read out and stored temporarily in the working RAM 121 and routine 131 thereafter is carried out.

If step 143 is NO, the processing proceeds to step 144 in which whether the disable switch DSW has been depressed or not is examined. If step 144 is YES, step 145 is carried out and the state of the register DR is inverted. In other words, the register DR is reset if it is in the set state whereas it is set if it is in the reset state.

The memories (RAMs 69, 70, 117, etc.) for storing preset data used in the above described embodiments which are capable of both writing and reading can be made nonvolatile by providing suitable means. For example, by employing battery back-up type memories or various nonvolatile RAM elements available in the market, preset data may be stored and held even when power is cut off.

What is claimed is:

1. An electronic musical instrument comprising:

a key switch circuitry including playing keys capable of being operated by a player of the instrument for designating respective notes, and including key switches and circuits associated with said keys and producing key identifying signals indicating operated ones among said keys;

tone generator means connected to said key switch circuitry for generating tone signals of the notes as respectively designated by said key identifying signals and having tone properties as determined by control data signals applied thereto;

control data providing means for providing at least a set of control data signals in a digital format representing respective tone properties of the tone signals to be generated, and outputting said set of control data signals timewisely in serial form; and control data setting means connected to said control data providing means and said tone generator means, and including serial to parallel conversion circuits receiving said outputted control data signals and converting the serial control data signals into parallel control data signals, a plurality of manual operator units connected to said serial to parallel conversion circuits and capable of setting the parallel control data signals by selectively either modifying or not modifying the parallel control data signals, and parallel to serial conversion circuits connected to said manual operator units and converting the parallel control data signals into serial control data signals, which last mentioned serial control data signals being applied to said tone generator means.

2. An electronic musical instrument as claimed in claim 1 wherein said control data providing means includes a memory device storing plural sets of control data signals in a digital format and a read-out circuit for selectively reading a set of control data signals out of said memory device.

3. An electronic musical instrument as claimed in claim 2 which further comprises a preset calling device coupled with said read-out circuit for selectively designating a set of control data signals to be read out.

4. An electronic musical instrument as claimed in claim 1 wherein each of said serial to parallel conversion circuits and each of said parallel to serial conversion circuits are constructed by a single shift register circuit.

5. An electronic musical instrument as claimed in claim 1, 2 or 3 wherein each of said manual operator units includes storing means for storing the control data signals provided by said serial to parallel conversion circuits and outputting the stored data signals in parallel, manual switch means for changing values of the data signals stored in said storing means by a manual switching operation and display means for visually displaying the values of the data signals stored in said storing means.

6. An electronic musical instrument comprising:

a key switch circuitry including playing keys capable of being operated by a player of the instrument for designating respective notes, and including key switches and circuits associated with said keys and producing key identifying signals indicating operated ones among said keys;

tone generator means connected to said key switch circuitry for generating tone signals of the notes as respectively designated by said key identifying signals and having tone properties as determined by control data signals applied thereto;

control data setting means for setting a plurality of control data signals exhibiting values for determining said tone properties; and interpolation means connected to said control data setting means for receiving at least one of said control data signals and providing, when the value of the received signal varies from a first value to a second value, an interpolating value which varies gradually from said first value to said second value, said interpolated signal and other control data signals which are not subjected to interpolation being applied to said tone generator means.

7. An electronic musical instrument as claimed in claim 6 wherein said control data signals to be subjected to the interpolation by said interpolation means are of such a type that the value thereof can be selectively set at any one of plural values.

8. An electronic musical instrument as defined in claim 6 wherein said interpolation means includes an output register, a circuit for generating a small value which is proportionate to difference between a value of data stored in said output register and a value of input data provided by said control data setting means and a circuit for adding this small value to or subtracting it from the data stored in said output register to rewrite said data and, when the data stored in said output register is different from the input data, the data stored in said output register is caused to approach the input data by repeatedly adding or subtracting the small value proportionate to the difference between the data stored in said output register and the input data.

9. An electronic musical instrument as claimed in claim 6 wherein said interpolation means includes an up-down counter and control means for comparing the output of said up-down counter and the input data provided by said control data setting means together to cause said up-down counter to up-count or down-count at a predetermined rate in accordance with values of the output data of said up-down counter and the input data until these values coincide with each other.

10. An electronic musical instrument as claimed in claim 6 wherein said control data setting means includes setting section having plural manual operators for individually setting values of the respective control data signals and preset means for presetting values of at least a set of control data signals and collectively selecting a set of the preset control data signals from among the preset control data signals and provides the control data signals set or selected by either said setting section or said preset means to said tone generator means and said interpolation means.

11. An electronic musical instrument as claimed in claim 10 wherein said setting section further includes storing means provided for the respective manual operators for storing values of the control data signals set by said manual operators and display means for visually displaying the values of the control data signals stored in said storing means and said preset means includes a memory circuit storing sets of preset values of the control data signals, switch means for selecting a set of the control data signals in said memory circuit and a control circuit for reading the set of the control data signals selected by said switch means out of said memory circuit and storing the read out control data signals in said storing means and causes the data stored in said storing means to be displayed by said display means and also to be supplied to said tone generator means and said interpolation means.

* * * * *